United States Patent [19]

Iten et al.

[11] 4,037,321

[45] July 26, 1977

[54] DOUBLE EDGE BLADE RAZOR

[75] Inventors: Clemens A. Iten; Malcolm B. Sykes, both of Staunton, Va.

[73] Assignee: Philip Morris Incorporated, New York, N.Y.

[21] Appl. No.: 740,783

[22] Filed: Nov. 11, 1976

[51] Int. Cl.[2] ..... B26B 21/06

[52] U.S. Cl. ..... 30/47; 30/66; 30/74.1

[58] Field of Search ..... 30/47, 51, 66, 74.1, 30/75, 84

[56] References Cited

U.S. PATENT DOCUMENTS

| | | | |
|---|---|---|---|
| 952,216 | 3/1910 | Saxton | 30/74.1 |
| 1,887,911 | 11/1932 | Aronson | 30/74.1 X |
| 1,906,631 | 5/1933 | Lambert | 30/66 |
| 2,015,901 | 10/1935 | Lambert | 30/66 |
| 2,347,596 | 4/1944 | DeSwart | 30/47 |
| 2,744,319 | 5/1956 | Cutler | 30/66 |
| 3,934,338 | 1/1976 | Braginetz | 30/47 |

*Primary Examiner*—Gary L. Smith
*Attorney, Agent, or Firm*—Watson, Leavenworth, Kelton & Taggart

[57] ABSTRACT

A safety razor in which a double edge blade is held clamped in shaving position between a bridge member and cap member carried on a mounting plate attached to a handle. To change the blade, the bridge member and cap are slid longitudinally of the mounting plate to a second or blade change position and the cap is lifted free to provide access to the blade for changing same.

18 Claims, 8 Drawing Figures

DOUBLE EDGE BLADE RAZOR

BACKGROUND OF THE INVENTION

The present invention relates to a safety razor of the type in which shaving head assembly components are slidably moved from a shaving position thereof to a second or release position for making a blade change.

Various forms of construction of safety razors using a sliding cap member are known, U.S. Pat. Nos. 1,906,631; 2,015,901; 2,347,596; 2,708,310; 2,744,319; 2,799,927; and 2,828,540 being representative. Such construction as disclosed in these patents are not fully satisfactory for present day requirements of low cost and simple manufacture of safety razors as essentially molded devices which embody characteristics of reliability for shaving purposes, convenience for effecting blade change, and made of only a few parts and of such character as to be readily manufactured in simple fashion at low cost.

SUMMARY OF THE INVENTION

The present invention is directed to an improved safety razor of simplified and inexpensive construction. It is applicable particularly to a double edge blade type razor, i.e., one having two shaving sides although it could be adapted with equal facility for use with single edge blades. Furthermore, and while described herein as utilized with two shaving side single cutting edge blade means, it could also be used with plural cutting edge blades wherein primary and secondary blade members are embodied with a suitable spacer, in manner similar to that described in U.S. Pat. No. 3,934,338, it being understood of course that the two, double cutting edge blade members with spacer therebetween desirably would be an assembled unit to permit ready and convenient blade changing.

In accordance with the present invention, the razor includes a handle and a shaving head assembly fixed to the upper end of the handle. The shaving head assembly is comprised of only three components, an elongated mounting plate fixed to and desirably, integral with the handle, a bridge member received on the mounting plate and on which can be received a double edge razor blade of conventional construction, and a cap member which is received on top of the blade. In normal shaving condition, the bridge member and cap member (and blade sandwiched therebetween) are disposed superposed on the mounting plate, and the shaving head assembly is disposed symmetrically of the handle. For removal of a used blade and insertion of a fresh blade, the bridge member which is captively slidably connected to the mounting plate, and the cap are slid longitudinally of the mounting plate to a position in which one end and a longitudinal portion of said components extend beyond one end of said mounting plate. In such position, downwardly depending lugs on the cap member and which normally in shaving condition of the razor girdingly engage marginal portions of the mounting plate, are released from engagement with the said marginal portions of the mounting plate so that the cap member can be lifted off the assembly to provide access for removal and replacement of the blade.

In shaving condition of the razor, cooperating structure on the underside of the bridge member and on the top surface of the mounting plate function to urge the bridge member upwardly for clamping the blade against the cap member, such structure conveniently taking the form of camming projections on the mounting plate top surface which are engaged by the tip ends of flexibly mounted fingers formed in the bridge member. Such arrangement also may include an upstandng element adjacent a mounting plate camming projection and engageable by one or more bridge member fingers which inhibits any sliding of the bridge member from its shaving position except upon application of a sliding force thereto in excess of a predetermined magnitude. Thus the assembly is maintained in shaving condition except when a blade change is to be made and the requisite force applied to shift the bridge member. When the bridge member is slid to a blade change position, the fingers move out of engagement with the camming projection. A stop abutment at said one end of the mounting plate is provided and is engaged by one or more of the bridge member fingers thereby to limit the extend to which said bridge member can be slid and to serve along with complemental projection - groove means carried on the bridge member and mounting plate to captively retain the bridge member connected with the mounting plate.

Means also are carried on the bridge member to cooperate with the longitudinal slot conventionally provided in the blade member for the purpose of longitudinally and laterally aligning the sharpened cutting edges of the blade relative to guards formed at the longitudinal marginal portions of the bridge member.

The invention, accordingly, comprises the features of construction, combination of elements and arrangement of parts, which will be exemplified in the construction hereinafter set forth and the scope of the invention will be indicated in the claims.

BRIEF DESCRIPTION OF THE DRAWINGS

A fuller understanding of the nature and objects of the present invention will be had from the following detailed description taken in conjunction with the accompanying drawings showing by way of example, a preferred embodiment of the inventive concept and in which.

Throughout the following description, like reference numerals are used to denote like parts in the drawings.

DESCRIPTION OF THE PREFERRED EMBODIMENT

Figure 1:
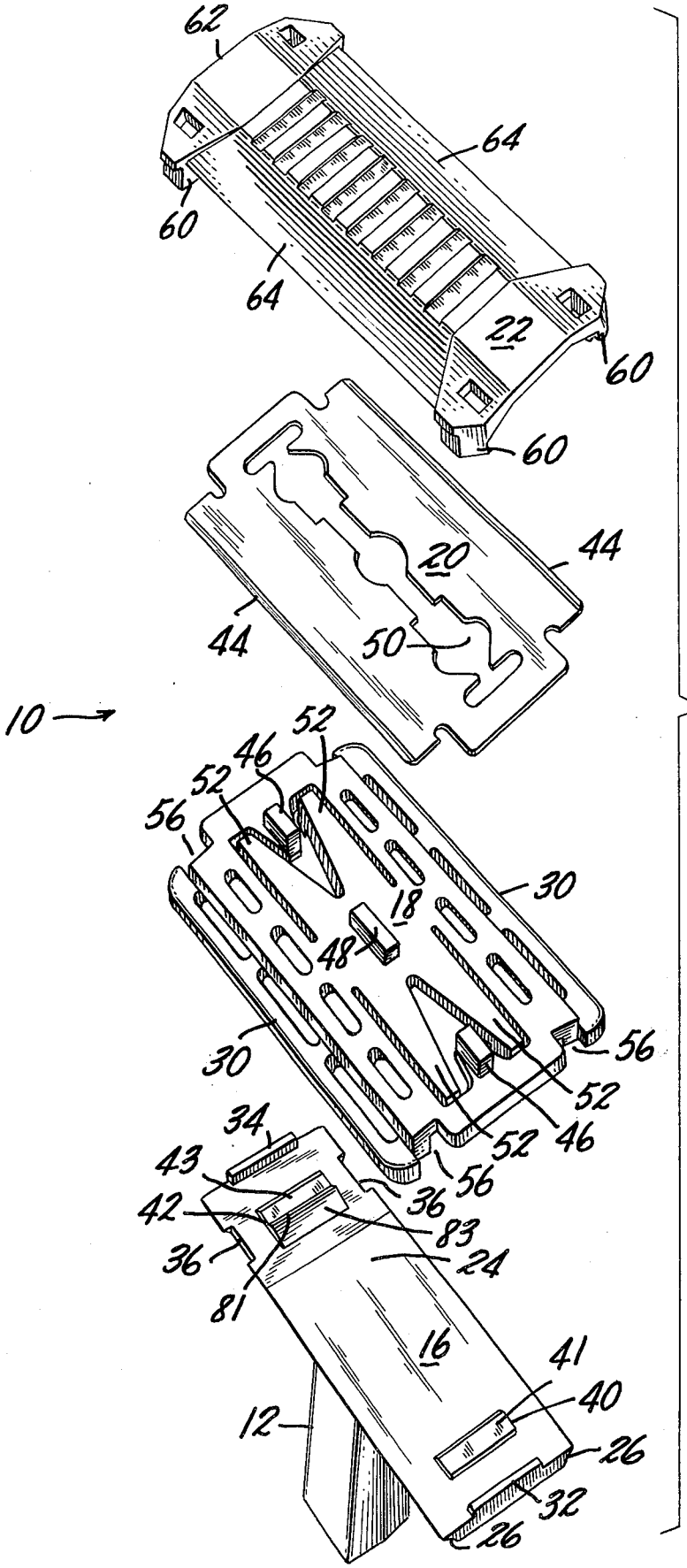
FIG. 1 is a perspective view of a razor constructed in accordance with the principles of the present invention, the shaving head components being depicted in exploded view.
Figure 2:
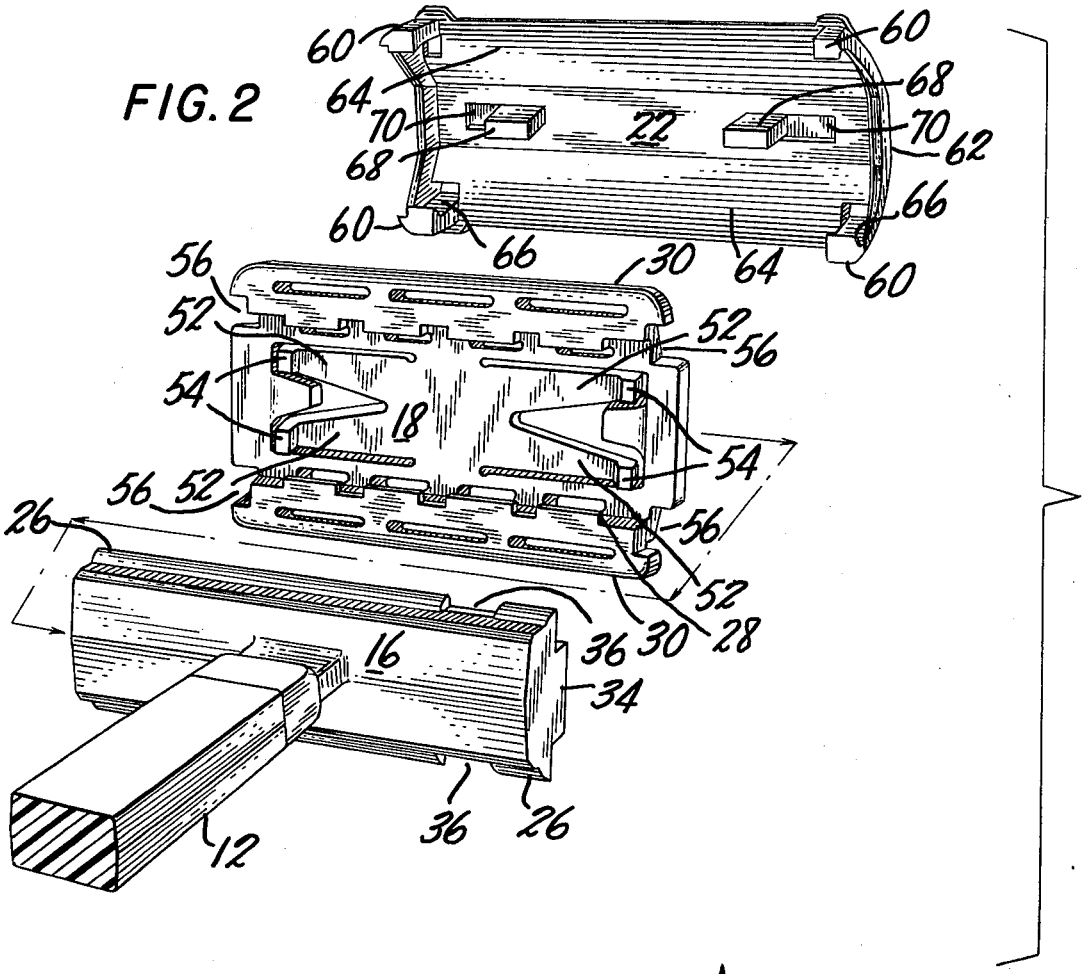
FIG. 2 is a perspective view in exploded detail of the shaving head mounting plate, bridge member and cap member as viewed from the bottom of each.

Referring now to FIGS. 1 and 2, there is depicted a razor 10 having a handle 12 on which is carried a shaving head assembly, the assembly including as components thereof, a mounting plate 16 rigidly fixed to the handle 12, a bridge member 18 captively slidably connected to the mounting plate, a conventional double edge razor blade 20 receivable of the bridge member, and a cap member 22 received on top of the razor blade and removable from the assembly in the manner to be described later in greater detail when it is desired to effect a blade change.

Mounting plate 16 is an elongated member which can have a generally flat upper surface 24 and the longitudinal side margins thereof be provided with projections 26 formed in any desirable configuration complemental with grooves 28 facing inwardly in longitudinal skirt portion 30 on bridge member 18 to thereby provide means for retaining the bridge member on the mounting plate but in such manner as to be free to slide thereon. In the depicted form, the projection - groove means are of dovetail configuration although other configurations could be employed, and the arrangement could be reversed with equal facility to provide grooves on the mounting plate and projections on the bridge skirts 30. The mounting plate is provided at its opposite transverse margins with upstanding abutments 32, 34, the abutment 34 being somewhat higher than abutment 32, but both functioning as will be described later on to limit the extent to which bridge member 18 can slide longitudinally of the mounting plate. The longitudinal margins of mounting plate 16 are notched or slotted adjacent one end of the plate as at 36, such notches constituting interruptions in the projections 26 and serving as will be noted later as clearance spaces for permitting lifting of the cap member 22 free from the head assembly. Mounting plate 16 also is provided with camming projections 40, 42 adjacent the two ends thereof, the camming projections extending upwardly a distance from the top or upper surface 24 of the mounting plate and serving to cooperate with structure at the underside of the bridge member to urge the bridge member upwardly for applying clamping force to the blade 20 and thereby clamp the blade against the cap member 22.

Bridge member 18 as can be noted from FIGS. 1 and 2 is an elongated member having as mentioned before a pair of longitudinal skirts 30 which are stepped down relative to the raised central body part of the bridge, the skirts functioning as guards in conventional manner so that the sharpened cutting edges 44 on the blade are located inwardly a distance of said skirts. The top side of the bridge is provided with a number of stakes 46, 48 which with the head assembly in shaving condition pass through the elongated central slot 50 in blade 20 and locate or fix the blade longitudinally and laterally on the bridge member. Moreover as the bridge member is moved from a shaving condition to a blade change position, the stakes insure that the blade slide unitarily with the bridge member. The central body part of the bridge member is provided with a number of flexibly mounted or cantilevered fingers 52, which fingers are arranged in longitudinally directed opposed pairs, the tip ends of the undersides of said fingers being provided with downwardly depending bosses 54. Cut outs or notches 56 are formed in the two transverse margins of the bridge member to provide thru passage for downwardly depending structure on the cap member 22, such structure being provided on the cap member as lugs 60 of construction and function to be described shortly.

Figure 3:
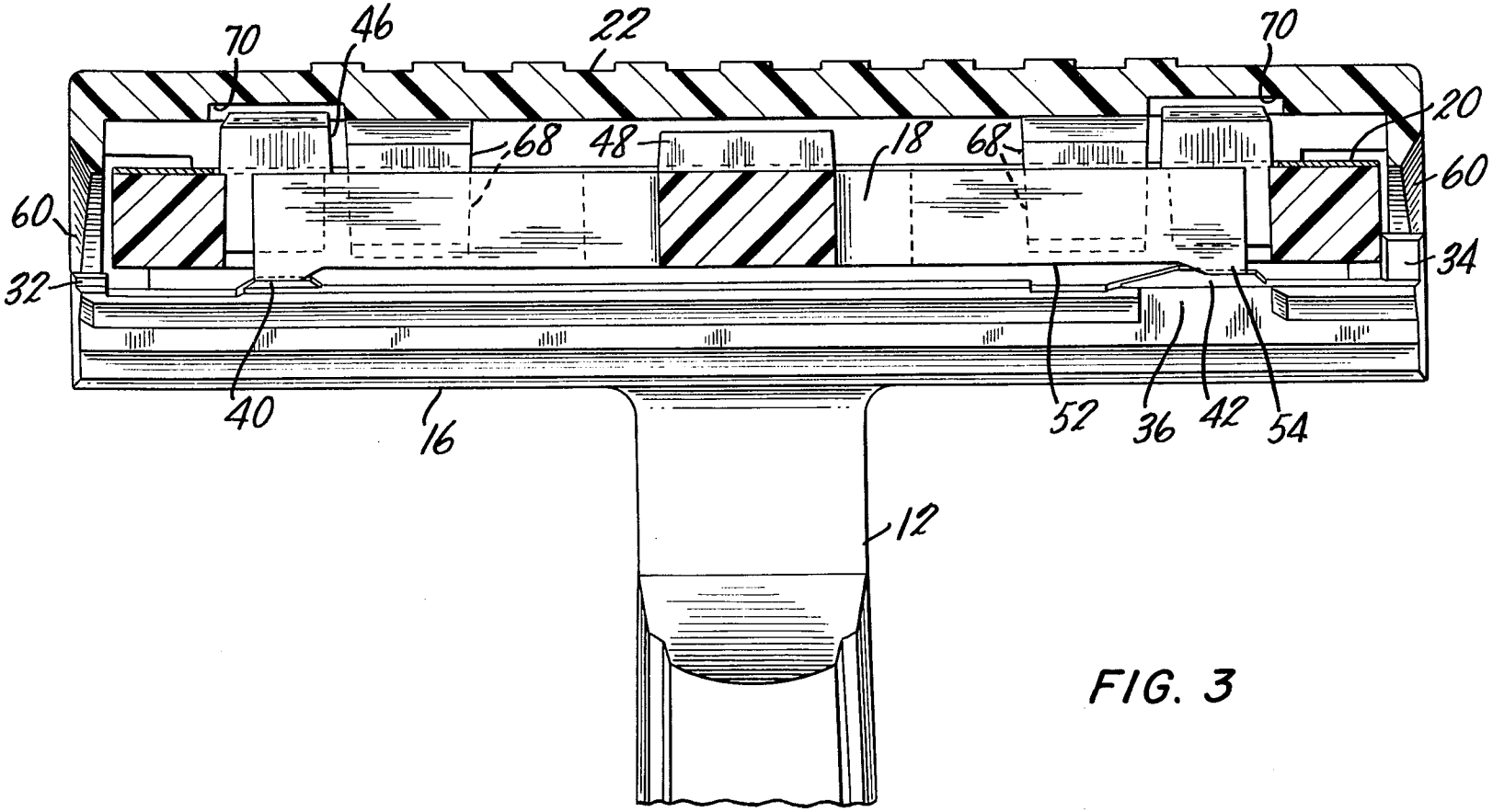
FIG. 3 is a front elevation view in section of the razor depicted in FIG. 1 portions of the cap member and bridge member being removed for purposes of clarity, with the razor head being in shaving position and particularly showing the manner in which upward bias is applied to the bridge member to effect clamping of the razor blade against the cap member.

Cap member 22 is also an elongated member having a cross sectional profile of arched configuration having a relatively flat crown or center portion 62 from which extends downwardly tapering sides 64, the sides terminating at the longitudinal and lateral extremes thereof in the downwardly depending lugs 60. The lugs 60 have three relatively straight sides with the fourth side of each defining an inwardly facing groove 66, such grooves 66 being complemental to the projections 26 on mounting plate 16 for sliding engagement therewith and to retain the cap member secured to the shaving assembly when the assembly is in shaving condition. As can be best noted in FIGS. 2–4, the underside of crown portion 62 is provided with posts 68 which pass down through the central slot 50 of blade member 20 for nesting in the triangular space between the adjacent fingers 52 of bridge member 18. Shifting of the bridge member between a shaving and blade replacement position results in unitary shifting movement not only of the blade 20 but also of the cap member the lugs 60 on the caps functioning to produce such effect. The underside of cap member 22 also is provided with upwardly recessed grooves 70 for reception of stakes 46 of the bridge member with the assembly in shaving condition thus insuring clearance for the stakes 46 when the bridge member is urged upwardly for clamping the blade. Such clearance insures that the stakes 46 do not engage the cap member in such manner as would prevent proper blade clamping.

A particular advantage of the razor 10 is the convenience and ease by which it can be manufactured from synthetic materials by molding processes. Thus it can be made from nylon, polypropylene and like materials and is relatively inexpensive to produce in comparison to known types of razors intended for like purposes.

Figure 6:
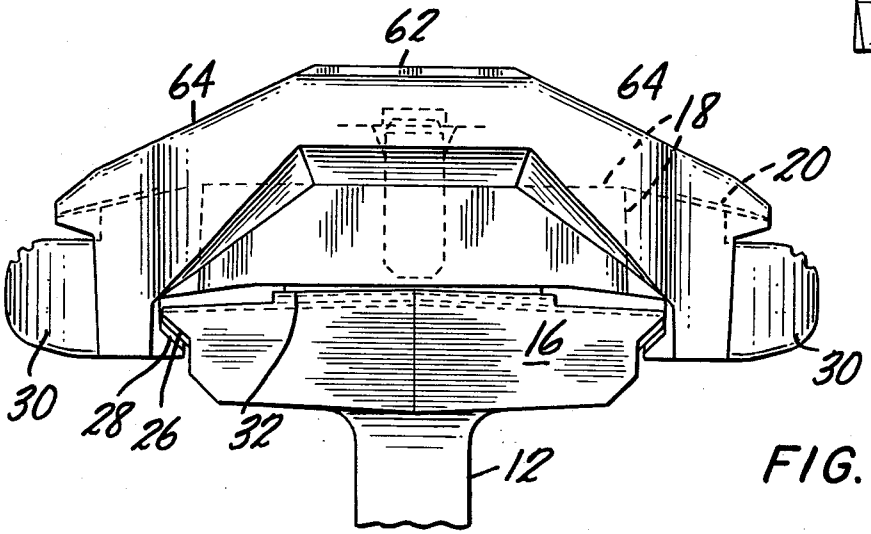
FIG. 6 is an end view of FIG. 3 as viewed from the left end of the razor.
Figure 5:
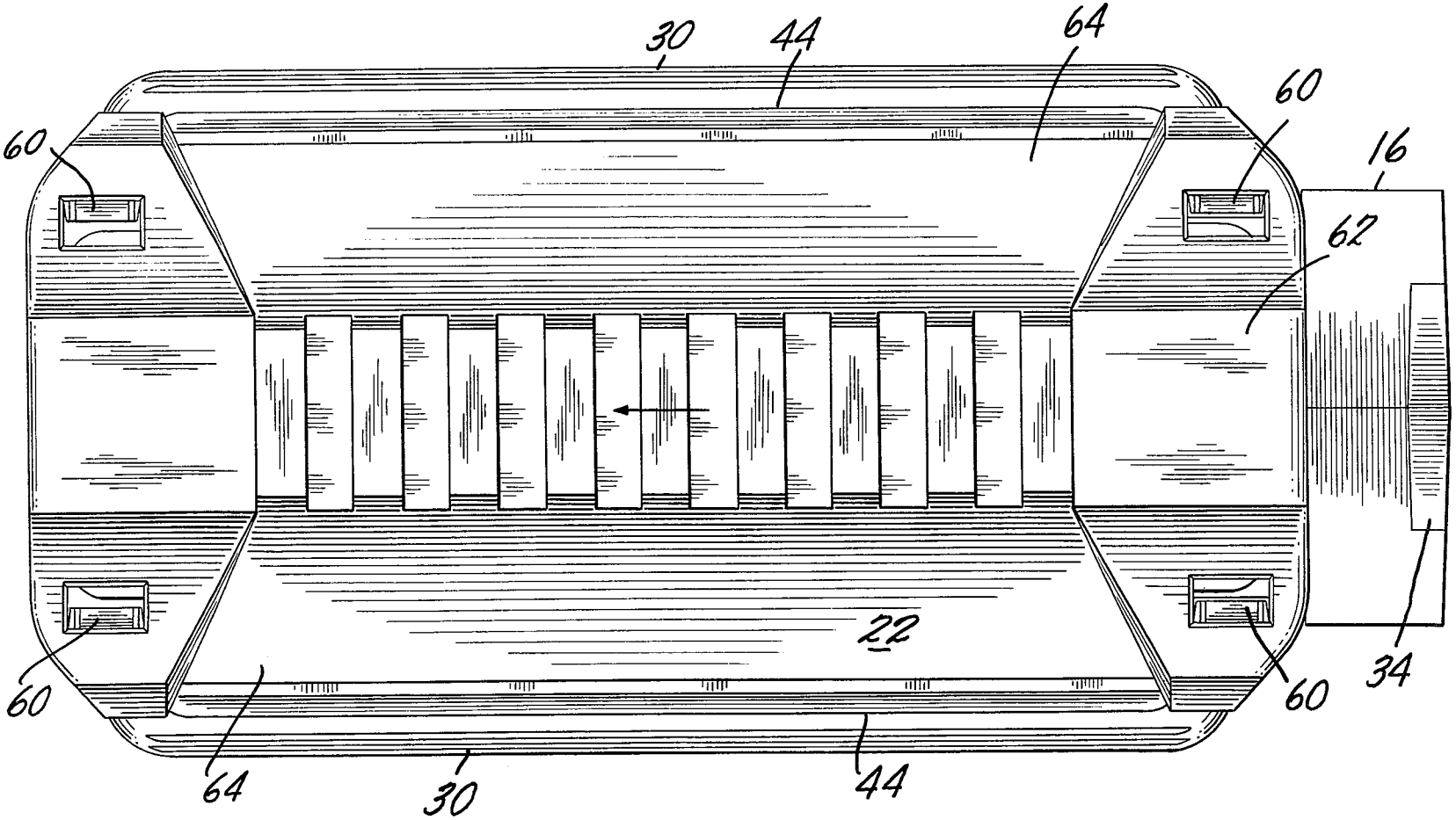
FIG. 5 is a plan view of the razor when the shaving head is in the position shown in FIG. 4.

Further understanding of the razor can be had from description of the manner in which it is used. The razor shaving head assembly has two positions. In the first or shaving position as for example depicted in FIGS. 3 and 6, the components of the shaving head (including mounting plate 16 fixedly connected to handle 12) are disposed symmetrically of the handle. In such first position, the grooves 66 on lugs 60 of the cap member are in complemental engagement with the projections 26 on the mounting plate 16, the lugs being located adjacent the opposite ends of mounting plate and passing down through the notches 56 in the bridge member. Further, the blade 20 is seated on top of the bridge member and the stakes 46 of the bridge locate the cutting edges 44 of the blade in shaving position relative to bridge guards 30, the stakes 46, 48 passing upwardly through blade slot 50 and the posts 68 of the cap member downwardly through such slot. In this shaving position, the bosses 54 at the underside tip ends of bridge fingers 52 are engaged or received in nested position on flats 41 and 43 of camming projections 40 and 42 respectively with the result that an upward bias is applied to the fingers and hence to the whole bridge member and thereby causing the bridge member to clamp the blade against the cap member holding it tightly to insure proper shaving retention of the same in the razor. In shaving position, the bridge member 18 is prevented from sliding on the mounting block 16, the right end transverse margin of the bridge being stopped against abutment 34 to preclude any rightward movement. To prevent leftward sliding travel of the bridge in shaving position, the camming projection 42 is provided adjacent the flat or planar surface 43 thereof with a further upwardly and slightly leftwardly inclined stop surface 81. In order for the bosses 54 on the rightside pair of fingers 52 of the bridge to ride up and over the surface 81, a sliding force in excess of a predetermined magnitude must be applied thereto. But since such force is not normally encountered in shaving, the bridge will remain secure in its first or shaving position. How the shaving head is shifted to its second position for making a blade change will be described next and with particular reference to FIGS. 4, 5, 7 and 8.

Figure 8:
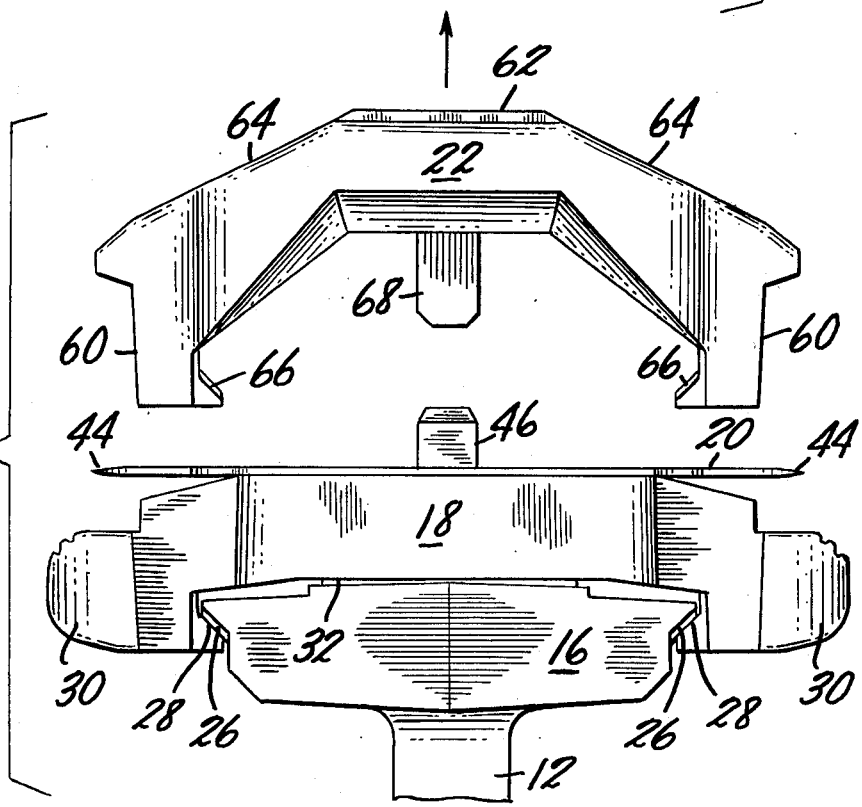
FIG. 8 is a left end view of FIG. 7.
Figure 4:
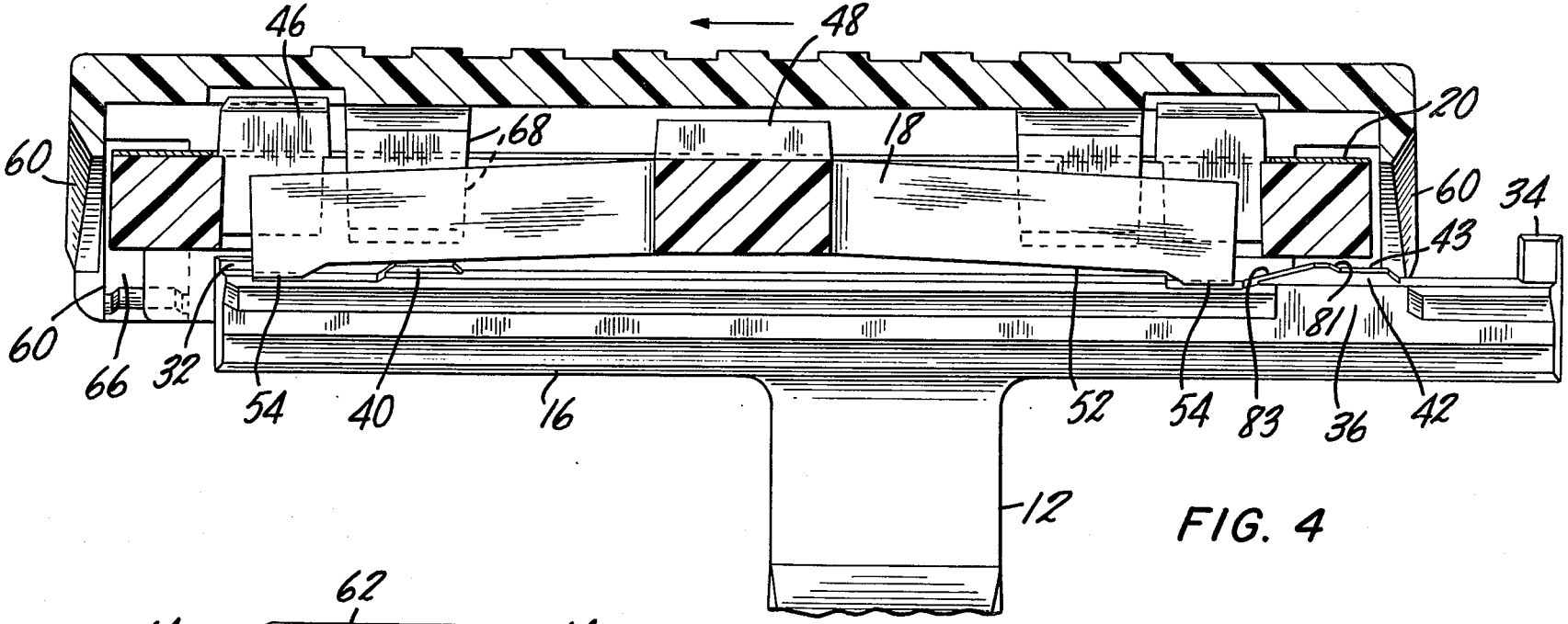
FIG. 4 is a view similar to FIG. 3 except it shows the shaving head assembly having been slid leftwardly from the position shown in FIG. 3 to a second position in which the cap member can be lifted free to allow blade change.
Figure 7:
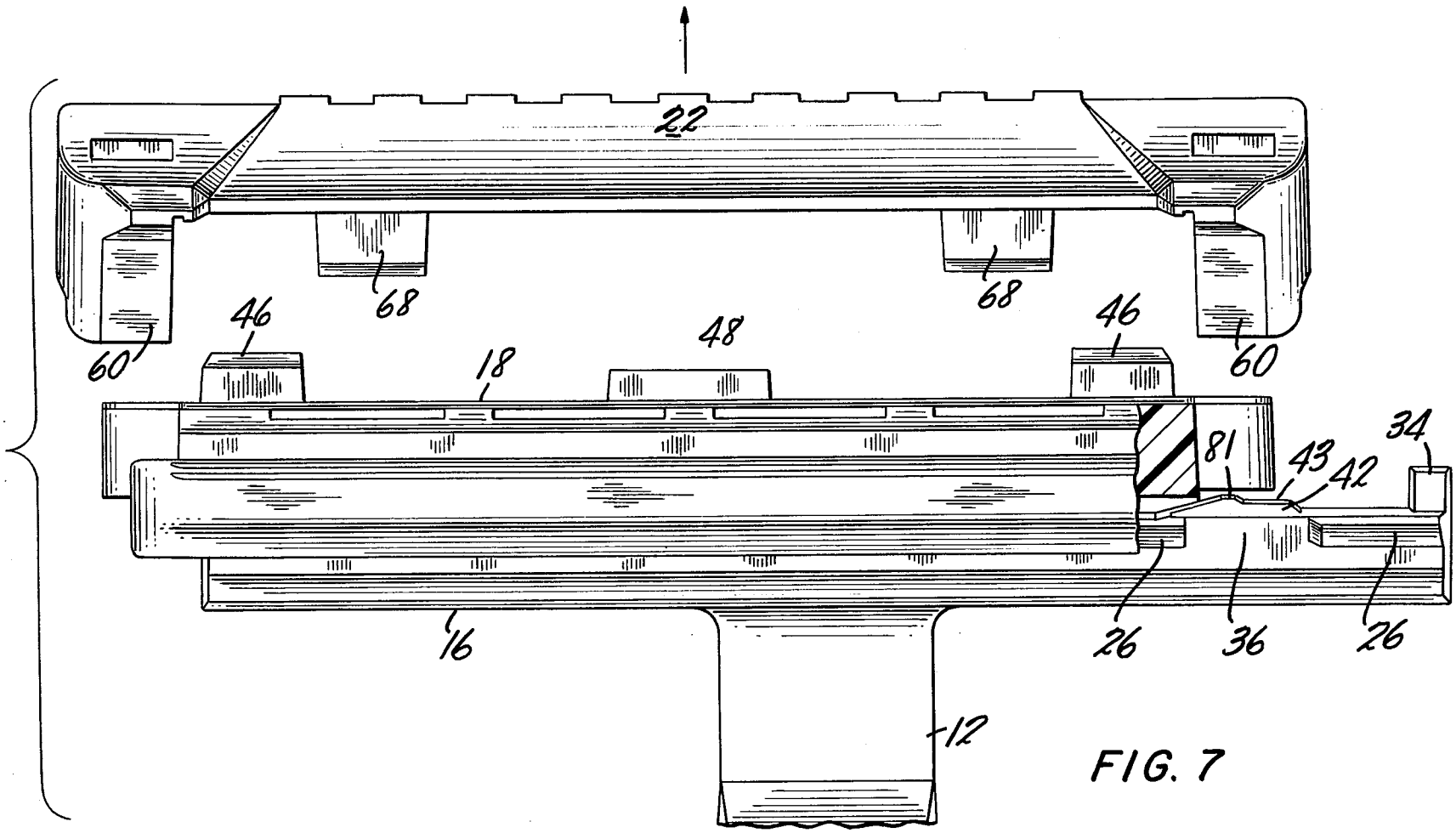
FIG. 7 is a front elevational view of the razor when the shaving head is in the position shown in FIGS. 4 and 5, with the cap member being depicted lifted off the assembly for making a blade change.

When a blade change is to be made, the bridge member 18, blade 20 and cap member 22 are shifted to a second or blade change position as seen, e.g., in FIG. 4 in which position an end and longitudinal portion of these components overhang an end of the mounting plate 16. In sliding the bridge from a shaving position to a blade change position, sufficient force is exerted to overcome the blocking effect of surface 81 and the finger bosses at the right side ride down inclined surface 83 and at the left side also clear surface 41, all of the bosses due to the flexible mounting of the fingers carrying the bosses, move down in the direction of the surface 24. Leftward travel of the bridge is terminated by the bosses 54 on the left side pair of fingers striking the transverse abutment 32. In this second or blade change position, the lugs 60 at the left end of cap member 22 will have slid clear of engagement with the projection 26 on the mounting plate, and those at the right side of the cap member will locate or register with notches 36. The cap member can then be lifted upwardly as shown in FIGS. 7 and 8 to remove same, the lugs passing upwardly clear through the notches 56 at the ends of the bridge member. A blade change is then made in usual fashion after which the cap is reinserted at the bridge, the blade and cap member then being slid rightwardly to restore the shaving head to shaving condition.

While there is disclosed but one embodiment of razor of the present invention, it is possible to produce still other embodiments without departing from the scope of the invention concept herein disclosed, and accordingly it should be understood that all matter contained in the above description, and in the accompanying drawings should be interpreted as illustrative and not in a limiting sense.

What is claimed is:

1. A razor including a handle and a shaving head assembly connected to said handle, said shaving head assembly comprising an elongated mounting plate fixed to said handle, said mounting plate having a top surface and being disposed symmetrically of said handle, an elongated bridge member received on the top surface of said mounting plate for sliding travel longitudinally of said mounting plate between first and second positions thereon, and vice versa, said bridge member in its first position being disposed symmetrically of said handle and in its second position having one end and a longitudinal portion thereof extending beyond one end of said mounting plate, a razor blade member received on top of said bridge member, and a cap member received on top of said blade member, there being cooperating means on said blade member and said bridge member and cooperating means on said cap member and said bridge member for unitarily moving said blade member and said cap member with bridge member when said bridge member is slid between its first and second positions, said cap member having downwardly depending structure girdingly engaging longitudinal marginal portions of said mounting plate when said bridge member is in said first position, the underside of said bridge member and the upper surface of said mounting plate having cooperating structure engageable when said bridge member is in said first position for urging said bridge member upwardly of said mounting plate thereby to clamp said blade member against said cap member, the cooperating structure at said bridge member underside and said mounting plate upper surface disengaging when said bridge member is slid to its second position, the downwardly depending structure on said cap member being released from engagement with the marginal portions of said mounting plate when said bridge member is moved to its second position whereby said cap member can be lifted upwardly free of said assembly to permit removal and replacement of said blade member.

2. A razor in accordance with claim 1 in which said bridge member is slidably mounted on said mounting plate by means of complementally configured projections and grooves carried on said mounting plate and said bridge member.

3. A razor in accordance with claim 2 in which said mounting plate is provided with laterally extending projections at the longitudinal margins thereof, said bridge member having laterally inwardly facing grooves provided in downwardly projecting skirts extending along the longitudinal margins of said bridge member.

4. A razor in accordance with claim 3 in which said mounting plate projections and bridge member grooves are of complemental dovetail configuration.

5. A razor in accordance with claim 3 in which the downwardly depending structure on said cap member which girdingly engages the longitudinal margin of said mounting plate comprises lugs on said cap member at the opposite ends thereof at the lateral extremes of said ends, said lugs having lower terminal parts provided with inwardly facing grooves configured complemental to the projections in said mounting plate.

6. A razor in accordance with claim 5 in which the longitudinal margins of said mounting plate are provided with inwardly directed notches defining interruptions in the projections at said mounting plate margins, the lugs at said one end of said cap member locating a distance beyond said mounting plate and disengaging from the projections on the longitudinal margins of said mounting plate and the lugs at the other end of said cap member registering with said notches when said bridge member is in its second position providing lifting clearance for said lugs when said cap member is lifted from said assembly.

7. A razor in accordance with claim 1 in which said blade member has an elongated slot extending longitudinally thereof, the means for unitarily moving said blade member with said bridge member including upstanding blade locator stakes carried on said bridge member and extending through said blade slot, said stakes locating the longitudinal edges of said blade in predetermined position relative to the longitudinal margins of said bridge member.

8. A razor in accordance with claim 7 in which the longitudinal margins of said bridge member comprise shaving guards.

9. A razor in accordance with claim 8 in which said shaving guards are stepped down relative to the remainder portion of said bridge member.

10. A razor in accordance with claim 1 in which the means for unitarily moving said cap member with said bridge member comprises said cap member downwardly depending structure, said structure closely engaging the opposite ends of said bridge member whereby sliding movement of said bridge member causes concurrent movement of said cap member.

11. A razor in accordance with claim 10 in which the opposite end margins of said bridge member are provided with slots for reception of said cap member downwardly depending structure.

12. A razor in accordance with claim 1 further comprising stop means for limiting the travel of said bridge member when same is moved from its first to second positions on the mounting plate, said stop means comprising an abutment upstanding from said mounting plate at said one end thereof, said abutment being engaged by a projection on the underside of said bridge member when said bridge member is in said second position.

13. A razor in accordance with claim 12 further comprising second stop means for limiting the travel of said bridge member when same is moved from its second to first positions on the mounting plate, said second stop means comprising a transverse member extending across the top of said mounting plate at its other end and having a height sufficient to present a barrier to said bridge member whereby sliding travel of same beyond said other end of said mounting plate is prevented.

14. A razor in accordance with claim 1 in which the bridge member and mounting plate cooperating structure for urging said bridge member upwardly comprises at least one camming projection extending upwardly from said mounting plate, and at least one boss carried at the underside of said bridge member, said camming projection engaging said boss when said bridge member is in said first position for applying upwardly directed force to said bridge member.

15. A razor in accordance with claim 15 in which said bridge member has a central body part raised upwardly relatively of said bridge member side longitudinal portions, said central body part being provided with at least one flexibly mounted longitudinally extending finger, said boss being carried at the tip end of said finger.

16. A razor in accordance with claim 15 in which said bridge member central body part is provided with two oppositely longitudinally directed pairs of flexibly mounted fingers, each having a boss at the underside of the tip end thereof, said mounting plate having a camming projection adjacent each end thereof, the bosses on one pair of fingers engaging on top of one of said camming projections and the bosses on the other pair of fingers engaging on the top of the other camming projections when said bridge member is in its first position, said bosses disengaging from said camming projection when said bridge member is moved to its second position.

17. A razor in accordance with claim 16 wherein said camming projections have at least in part planar upper surfaces, said upper surfaces being spaced a predetermined distance above said mounting plate top surface.

18. A razor in accordance with claim 17 in which at least one of said camming projections has a stopping abutment adjacent said planar upper surface for inhibiting sliding movement of said bridge member from its first to second position except upon application of sliding force thereto in excess of a predetermined magnitude.

* * * * *